US011385561B2

(12) United States Patent
Suzuki et al.

(10) Patent No.: US 11,385,561 B2
(45) Date of Patent: Jul. 12, 2022

(54) DRIVING APPARATUS AND PRINTING APPARATUS

(71) Applicant: CANON KABUSHIKI KAISHA, Tokyo (JP)

(72) Inventors: Tatsuya Suzuki, Kokubunji (JP); Tatsuya Ryoki, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/010,476

(22) Filed: Sep. 2, 2020

(65) Prior Publication Data

US 2021/0072661 A1 Mar. 11, 2021

(30) Foreign Application Priority Data

Sep. 10, 2019 (JP) ..... JP2019-164782

(51) Int. Cl.
*G03G 15/04* (2006.01)
*G03G 15/043* (2006.01)

(52) U.S. Cl.
CPC ..... *G03G 15/04054* (2013.01); *G03G 15/043* (2013.01)

(58) Field of Classification Search
None
See application file for complete search history.

(56) References Cited

U.S. PATENT DOCUMENTS

| | | | | |
|---|---|---|---|---|
| 9,362,896 | B2 | 6/2016 | Suzuki | |
| 11,067,916 | B2 | 7/2021 | Suzuki | |
| 2010/0097437 | A1* | 4/2010 | Nagumo | H03K 17/122 347/237 |

FOREIGN PATENT DOCUMENTS

JP H07-156444 A 6/1995

OTHER PUBLICATIONS

JP_07156444_A_T MachineTranslation, Japan, Chiba Jun. 1995.*

* cited by examiner

*Primary Examiner* — Victor Verbitsky
(74) *Attorney, Agent, or Firm* — Venable LLP

(57) ABSTRACT

A driving apparatus is provided. The driving apparatus comprises a plurality of driving circuits configured to generate a current according to an inputted voltage. The plurality of driving circuits are formed on a single semiconductor chip, and each of the plurality of driving circuits comprises a plurality of output circuits configured to supply the current to a plurality of load elements arranged in at least one load element array.

10 Claims, 9 Drawing Sheets

DRIVING APPARATUS AND PRINTING APPARATUS

BACKGROUND OF THE INVENTION

Field of the Invention

The present invention relates to a driving apparatus and a printing apparatus.

Description of the Related Art

Japanese Patent Laid-Open No. H7-156444 describes a driving circuit that performs control of light emission according to constant current driving. By supplying an analog output voltage that accords with a density data signal to a current setting circuit corresponding to each LED, and a current setting circuit supplying a current in accordance with an output voltage to each LED, it is possible to control light emission output for each LED.

SUMMARY OF THE INVENTION

In a driving circuit that drives a plurality of light-emitting element arrays in which a large number of load elements such as LEDs are respectively arranged, as illustrated in Japanese Patent Laid-Open No. H7-156444, it is necessary to reduce the circuit scale of the driving circuit in order to reduce an increase in the chip size of a driving apparatus in which a driving circuit is provided.

Some embodiments of the present invention provide a technique advantageous at reducing the circuit scale of a driving apparatus.

According to some embodiments, a driving apparatus, comprising: a plurality of driving circuits configured to generate a current according to an inputted voltage, wherein the plurality of driving circuits are formed on a single semiconductor chip, and each of the plurality of driving circuits comprises a plurality of output circuits configured to supply the current to a plurality of load elements arranged in at least one load element array, is provided.

Further features of the present invention will become apparent from the following description of exemplary embodiments (with reference to the attached drawings).

DESCRIPTION OF THE EMBODIMENTS

Figure 1:
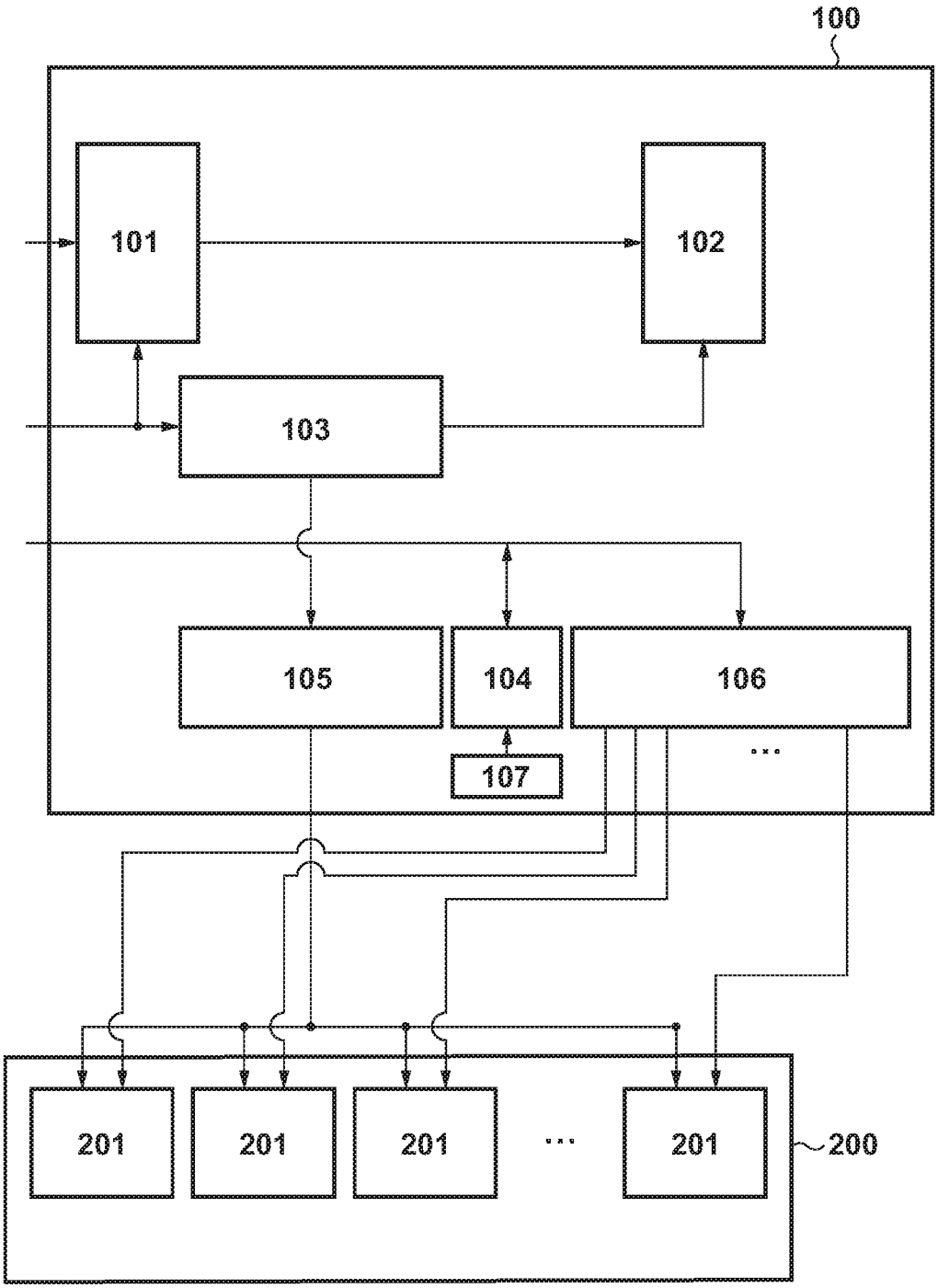
FIG. 1 is a block diagram illustrating an example of a configuration of a driving apparatus in the present embodiment.

Hereinafter, embodiments will be described in detail with reference to the attached drawings. Note, the following embodiments are not intended to limit the scope of the claimed invention. Multiple features are described in the embodiments, but limitation is not made an invention that requires all such features, and multiple such features may be combined as appropriate. Furthermore, in the attached drawings, the same reference numerals are given to the same or similar configurations, and redundant description thereof is omitted.

In the description below, an example of a case in which a driving apparatus of the present embodiment drives a light-emitting element which is a load element as an exposure head will be described. Also, an example in which a light-emitting thyristor is used as a light-emitting element will be given. However, the driving apparatus of the present embodiment is not limited to controlling light emission of light-emitting elements, and may be applied to current control for all current-driven elements. Within current-driven elements, light-emitting elements may require a high level of accuracy in control since many are used in printing apparatuses such as image forming apparatuses or the like. Also, in printing apparatuses such as image forming apparatuses and the like, since many light-emitting elements are arranged, the circuit scale of the driving apparatus may become large. Accordingly, a driving apparatus of the present embodiment by which it is possible to reduce the circuit scale of a driving apparatus and also control light emission to a high level of accuracy will be described.

With reference to FIG. 1 to FIG. 8, a structure and operation of the driving apparatus according to the present embodiment will be described. FIG. 1 is a block diagram illustrating an example of a configuration of a driving apparatus 100 in the present embodiment. The driving apparatus 100 may comprise a data reception unit 101, a period control unit 102, a timing control unit 103, a voltage control unit 104, a control signal generation unit 105, a driving unit 106, and a memory 107. The data reception unit 101 has a circuit for receiving, from a unit external to the driving apparatus 100, image data corresponding to a light emitting unit 200 in which at least one of a light-emitting element array 201 is arranged, and the data reception unit 101 can process the light-emitting element array 201 in parallel. The period control unit 102 generates a pulse signal (hereinafter may be referred to as a drive signal) for outputting to a light-emitting element arranged in the light-emitting element array 201 in accordance with data inputted from the data reception unit 101. Though described later, a period of time over which each light-emitting element arranged in the light-emitting element array 201 is caused to be driven is controlled by this drive signal. The timing at which the drive signal is outputted is controlled by the timing control unit 103. The timing control unit 103 generates a synchronization signal corresponding to each of the light-emitting element arrays 201 from a signal inputted from outside of the driving apparatus 100, and transmits it to the period control unit 102 and the control signal generation unit 105. The voltage control unit 104 controls the voltage to be supplied to a driving circuit arranged in the driving unit 106. The voltage control unit 104, based on information of the memory 107 in which information for controlling driving of each of the plurality of light-emitting elements arranged in the light-emitting element array 201 of the light emitting unit 200 is stored, may supply voltage to each driving circuit of the driving unit 106. For example, a difference between an adjustment target light amount and an amount of light of each light-emitting element is detected in a factory inspection process or the like, and a driving voltage data Vx by which an optical output of an adjustment target value will be achieved is stored in the memory 107. For example, as information for controlling driving, a lookup table or an arithmetic formula indicating a relationship between a target light amount and a driving voltage for each light-emitting element may be stored in the memory 107. The control signal generation unit 105, in accordance with a synchronization signal generated by the timing control unit 103, generates control signals Φs, Φ1, and Φ2 for transfer of a shift thyristor arranged in the light-emitting element array 201. The driving unit 106 has a plurality of driving circuits for supplying to the light-emitting element a current for causing a light-emitting element to be driven in synchronism with a drive signal. In the present embodiment, as an example of the driving apparatus 100, the block diagram of FIG. 1 is illustrated, but the configuration of the driving apparatus 100 is not limited to this. The driving apparatus 100, in accordance with the intended use, may comprise a configuration in which any of the data reception unit 101, the period control unit 102, the timing control unit 103, the voltage control unit 104, the control signal generation unit 105, and the memory 107 are arranged externally to the driving apparatus 100.

Since there is variation in the forward voltage drop amount and internal resistance values and the like of light-emitting elements due to manufacturing variation in light-emitting elements such as the light-emitting thyristor, the driving current needed for a predetermined light emission may differ for each light-emitting element. Accordingly, there are cases where the amount of light emitted differs for each light-emitting element in the case where the same current has been supplied to the light-emitting elements. In a printing apparatus such as an image forming apparatus using the light emitting unit 200 in which a light amount unevenness occurs due to such variation in light emission and in which, for example, a plurality of light-emitting element arrays 201 are arranged, there are cases where a density unevenness occurs in a print result and image quality suffers.

Figure 2:
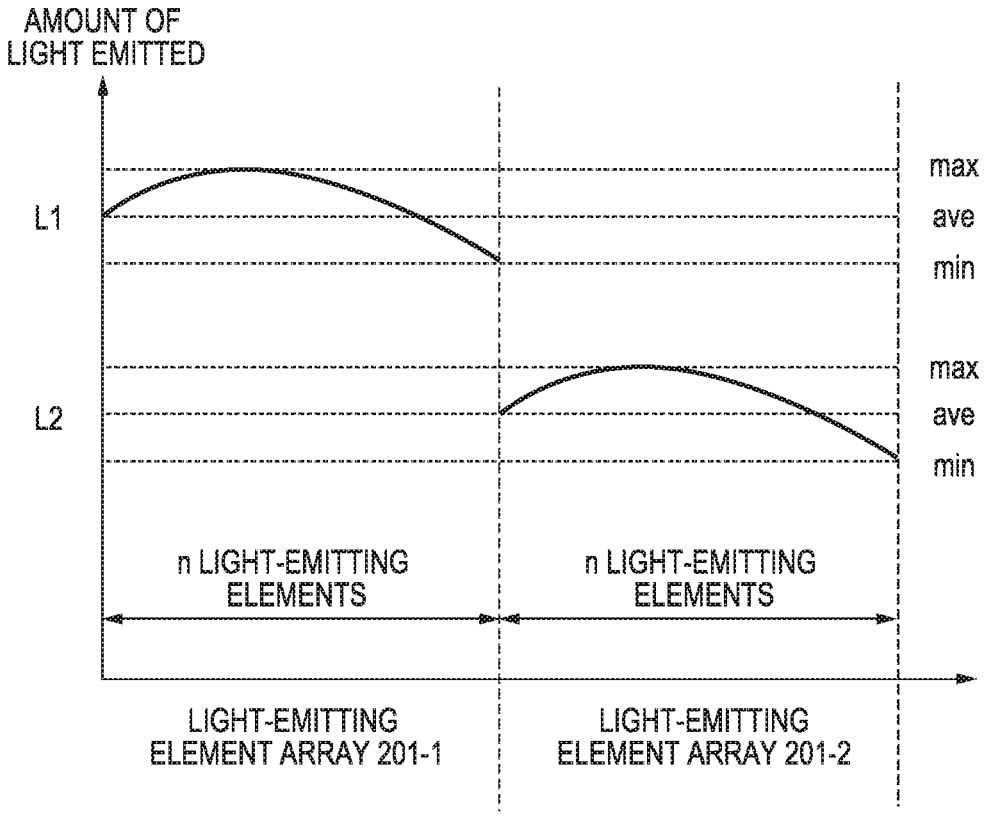
FIG. 2 is a view illustrating an example of variation in an amount of light emitted by light-emitting element arrays that the driving apparatus of FIG. 1 drives.

As illustrated in FIG. 1, a plurality of light-emitting element arrays 201 are arranged in the light emitting unit 200. Also, a plurality of light-emitting elements are arranged in each of the light-emitting element arrays 201. The variation between light-emitting elements in the forward voltage drop amount, the internal resistance value, and the like within one of the light-emitting element arrays 201 is typically lower compared to the variation in the average value of the forward voltage drop amount or the average value of internal resistance or the like between light-emitting element arrays 201. FIG. 2 illustrates an example of a variation between light-emitting elements and between light-emitting element arrays 201. FIG. 2 illustrates a change in an amount of light emitted in a case where the same amount current is supplied to two light-emitting element arrays 201; the abscissa indicates a line of light-emitting elements of the light-emitting element array 201, and the ordinate indicates the corresponding amount of light emitted therefrom. In order to correct such variation in the amount of light emitted by the light-emitting elements, in a case where a control circuit for controlling a current that drives a light-emitting element for each light-emitting element is prepared, the chip size of the driving apparatus 100 increases as the circuit scale of the driving apparatus 100 becomes larger.

Accordingly, in the present embodiment, by arranging a plurality of driving circuits that drive light-emitting elements in the driving apparatus 100 in correspondence with the light-emitting element arrays 201 in which the plurality of light-emitting elements are arranged, rather than the light-emitting elements, the circuit scale of the driving apparatus 100 is reduced. Firstly, using FIG. 3 and FIG. 4, detailed description will be given for reducing the circuit scale of the driving circuit 301 arranged in the driving unit 106 of the driving apparatus 100 and for correcting of variation in light emission.

Figure 3:
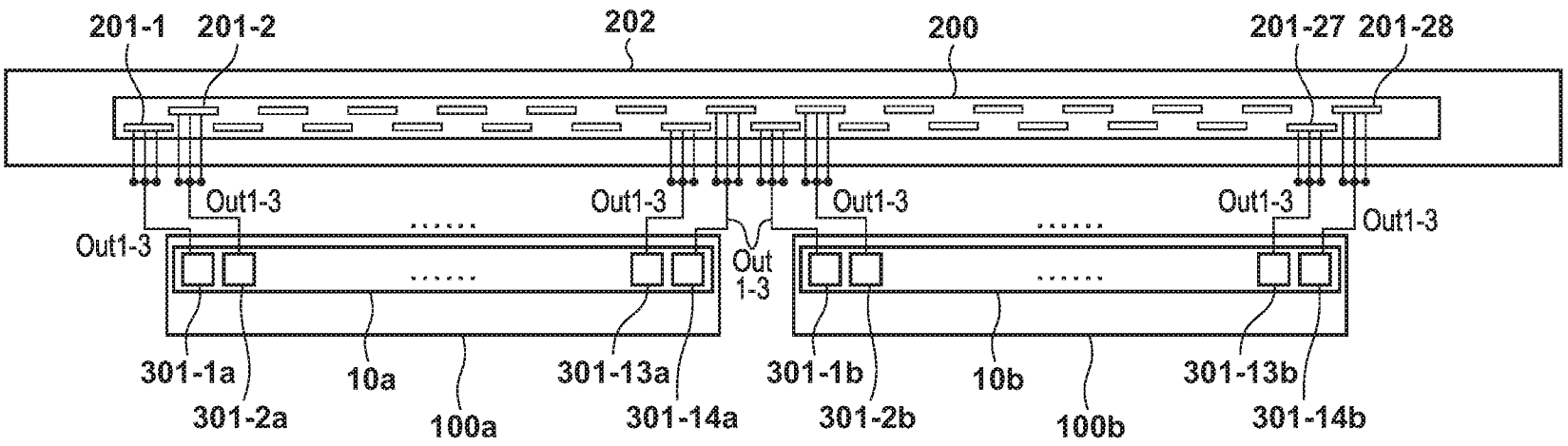
FIG. 3 is a view illustrating a relationship between the driving apparatus of FIG. 1 and the light-emitting element arrays.

FIG. 3 is a view illustrating a relationship between the plurality of driving circuits 301 arranged in the driving apparatus 100 and the plurality of light-emitting element arrays 201 arranged in the light emitting unit 200. In a print substrate 202, the light emitting unit 200 in which a plurality of light-emitting element arrays 201 are arranged is implemented. In the configuration illustrated in FIG. 3, in the light emitting unit 200, 28 light-emitting element arrays 201-1 to 201-28 are arranged, and by two the driving apparatuses 100*a* and 100*b*, the light-emitting elements arranged in the respective light-emitting element arrays 201 are driven. In driving circuit unit 10*a* of the driving apparatus 100*a*, 14 driving circuits 301-1*a* to 301-14*a* are arranged, and similarly, in a driving circuit unit 10*b* of the driving apparatus 100*b*, 14 driving circuits 301-1*b* to 301-14*b* are arranged. Each of the plurality of driving circuits 301 comprises a plurality of output circuits for supplying current respectively to the plurality of load elements arranged in a load element array 201. In one output circuit, one output terminal OUT is arranged. In the present embodiment, each driving circuit 301 comprises three output circuits 1001, and the output terminals OUT1 to 3 of the output circuit are connected to the lighting signal lines of the light-emitting element array 201. Also, in the configuration illustrated in FIG. 3, each driving circuit 301 is arranged so respectively correspond to one load element array 201. However, limitation is not made to this, and as described later, each driving circuit 301 may be arranged to correspond respectively with a plurality of load element arrays 201. Also, one load element array 201 may be driven using a plurality of driving circuits 301, for example.

Figure 4:
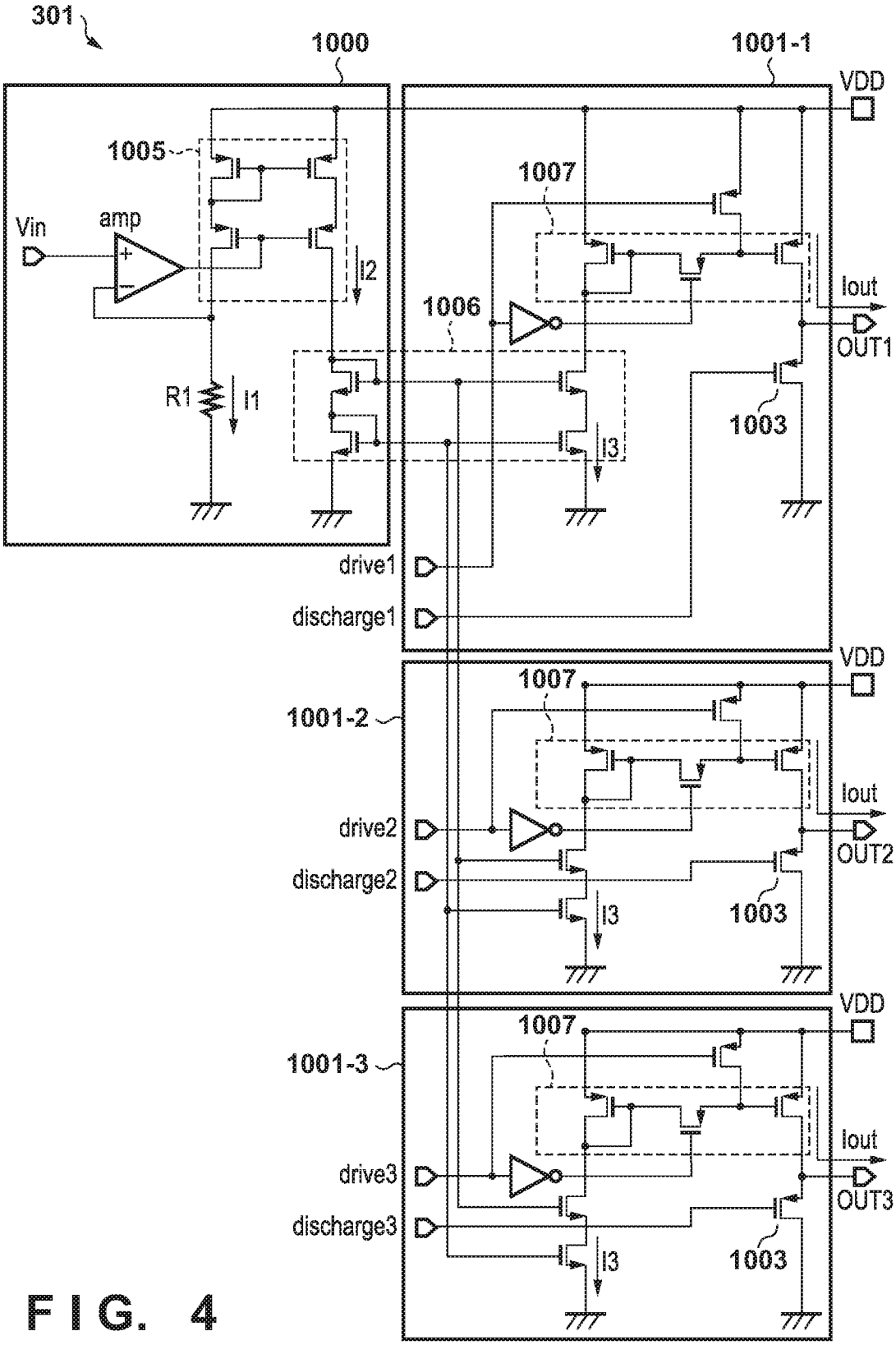
FIG. 4 is a circuit diagram illustrating an example of a configuration of a driving circuit of the driving apparatus of FIG. 1.

A configuration example of the driving circuit 301 is illustrated in FIG. 4. The driving circuit 301 includes a current generation unit 1000 for generating a current according to an inputted voltage and a plurality of output circuits 1001 respectively comprising an output terminal OUT for supplying current to the load element. The current generation unit 1000 generates a current I1=Vin/R1 determined by a resistor R1 in accordance with the input voltage Vin. The input voltage Vin is supplied by the voltage control unit 104 based on the driving voltage data Vx stored in the memory 107. As described above, the driving voltage data Vx is data indicating a driving voltage that is necessary when emitting light at a predetermined target light amount for each light-emitting element array 201. The voltage control unit 104 calculates a target average light amount for each light-emitting element array 201 from a driving signal to the respective light-emitting element array 201 supplied from the outside of the driving apparatus 100, and obtains driving voltage data Vx by which a target value will be achieved from the memory 107. The voltage control unit 104 inputs a voltage value based on the driving voltage data Vx as the input voltage Vin for each driving circuit 301. As described above, by changing the voltage value supplied to each current generation unit 1000 of the driving circuit 301, it is possible to control the current value I1 to a desired value. For example, the voltage control unit 104 controls the voltage (the input voltage Vin) to mutually different voltage values for a first drive circuit and a second drive circuit included in the plurality of driving circuits 301.

In the current generation unit 1000, current I2 is generated from the current I1 via a current mirror circuit 1005. The current generation unit 1000 and the output circuit 1001 configure a current mirror circuit 1006. By the current mirror circuit 1006, a current I3 is generated from the current I2, and the current I3 is supplied to each output circuit 1001. In the output circuit 1001, including a current mirror circuit 1007, a current IOUT for causing each light-emitting element to be driven is generated from the current I3. As described above, the current I1 generated in accordance with the input voltage Vin by the current generation unit 1000 is multiplied by three the current mirror circuits 1005 to 1007 at a ratio according with each mirror ratio, and outputted as a current IOUT from the output terminal OUT of the output circuit 1001.

Each output terminal OUT1 to OUT3 of the three output circuits 1001 illustrated in FIG. 4 is connected to one of the lighting signal lines ΦW1 to ΦW3 of the light-emitting element (light-emitting thyristor) of the self-scanning light-emitting element array 201 (details will be described later) illustrated in FIG. 5. In other words, the output terminals OUT1 to OUT3 of each of the plurality of output circuits 1001 of the driving circuit 301 end up being connected to respectively different load elements among the plurality of load elements. In order to support the three lighting signal lines ΦW1 to ΦW3 illustrated in FIG. 5, the output circuit 1001 of the driving circuit 301 requires three channels. The number of output circuits 1001 is not limited to three, and may be two or may be four or more. It is sufficient to arrange them as appropriate in accordance with the number of lighting signal lines arranged in the light-emitting element array 201.

In the output circuit 1001, a drive signal (pulse signal) supplied from the period control unit 102 controls the timing and period for the current IOUT being supplied to the light-emitting element array 201. The drive signal has two states: Hi and Lo. In the period in which the drive signal is Lo, the current IOUT is not supplied from the output terminal OUT of the output circuit 1001 of the driving circuit 301. In the period in which the drive signal is Hi, the current IOUT is supplied from the output terminal OUT of the output circuit 1001 of the driving circuit 301. For example, the period control unit 102, in relation to a plurality of output circuits 1001 comprised by one of the plurality of driving circuits 301, controls each of the plurality of output circuits 1001 such that the length of the period in which one of the plurality of output circuits 1001 supplies the current IOUT and the length of the period in which another one of the plurality of output circuits 1001 supplies the current IOUT differ. The current IOUT is supplied to the light-emitting element array 201 from the output terminal OUT of the output circuit 1001 as a pulse signal. By the input voltage Vin according to the voltage set by the voltage control unit 104, the current value (height of the pulse signal) of the current IOUT is controlled, and by the period in which the period control unit 102 output Hi as the drive signal, the period (width of the pulse signal) in which the current is supplied is controlled.

Also, the driving circuit 301 may have a configuration for resetting supply of current by the output circuit 1001. More specifically, the output circuit 1001 may comprise a switch 1003 for connecting the output terminal OUT of the output circuit 1001 to a predetermined electric potential such as a ground potential or the like. As illustrated in FIG. 4, by a discharge signal inputted from outside of the driving apparatus 100, the switch 1003 between the output terminal OUT and the ground potential GND may be controlled. In the period where the discharge signal is Hi, the switch 1003 operates as ON, and, by the output terminal OUT being connected to the ground potential GND, the output circuit 1001 (the driving circuit 301) enters a reset state.

The amount of light emitted by the light-emitting element arranged in the light-emitting element array 201 can be controlled by the height and width of the pulse signal of the current IOUT, and it is possible to control light emission variation by adjusting the height and the width of the pulse signal. As described above, the voltage control unit 104, based on the driving voltage data Vx stored in the memory 107, can set a predetermined current IOUT. The voltage control unit 104 may supply, to the driving circuit 301, voltage at a 7 bit resolution (128 steps) using a DAC (a digital-to-analog conversion control circuit), for example. In a case where the maximum value of the height of the pulse signal of the current IOUT is a maximum value (127) of the DAC (7 bit), the height of the pulse signal can be controlled at an approximately 0.8% resolution. As described above, the height of the pulse signal of the current IOUT can be set for each driving circuit of the plurality of driving circuits 301 arranged in the driving apparatus 100, and the height of the pulse signal of the current IOUT supplied to each light-emitting element array 201 can be changed. Thereby, it is possible to correct variation in light emission between the light-emitting element arrays 201.

Also, for the period in which each light-emitting element arranged in the respective light-emitting element array 201 emits light, the width (output period) of the pulse signal is calculated by the period control unit 102, and supplied as the drive signal. The period control unit 102 may supply the drive signal at a 6 bit (64 step) resolution, for example. In a case where the drive signal output period is 150 ns, the time for a single division is approximately 2.3 ns, and it is possible to control the width of the pulse signal at approximately 1.6% resolution. As described above, by changing the width of the pulse signal of the drive signals 1 to 3 supplied to the output circuit 1001, it is possible to set the width of the pulse signal of the current IOUT corresponding to each light-emitting element. Thereby, it is possible to correct light emission variation between light-emitting elements in each of the light-emitting element arrays 201.

As described above, in order to correct light emission variation among the light-emitting elements arranged in the light-emitting element arrays 201, a circuit that controls the height of the pulse signal of the current IOUT supplied in correspondence with each light-emitting element array 201 and controls the width of the pulse signal of the current IOUT in correspondence with the light-emitting element within the light-emitting element array 201 is provided. Thereby, it is possible to reduce the circuit scale of the driving apparatus 100 and perform higher precision light emission control as compared with the case where a circuit for setting a current for driving the light-emitting element for each light-emitting element is arranged as illustrated in Japanese Patent Laid-Open No. H7-156444.

As described above, the variation between light-emitting elements within each light-emitting element array 201 is typically smaller compared to the light emission variation between the light-emitting element arrays 201. Accordingly, as described above, the resolution for when the period control unit 102 supplies the drive signal for controlling the period over which a current is supplied may be lower than the resolution for when the voltage control unit 104 supplies the input voltage Vin. However, limitation is not made to this, and the period control unit 102 may have equivalent resolutions for the resolution for when supplying the drive signal for controlling the period in which the current is supplied and the resolution for when the voltage control unit 104 supplies the input voltage Vin. In accordance with the specification required by the driving apparatus 100 and the set circuit scale, the resolutions of the period control unit 102 and the voltage control unit 104 may be set as appropriate.

Next, as an example of the light-emitting element array 201 described above, a self scanning light-emitting element array including a light-emitting thyristor element will be described. FIG. 5 is an equivalent circuit diagram that illustrates a portion of the self-scanning light-emitting element array driven by the driving apparatus 100 of the present embodiment. Ra and Rg are respectively an anode resistor and a gate resistor; T indicates a shift thyristor, D indicates a coupling diode, and L indicates a light-emitting thyristor. Also, G denotes a common gate of a corresponding shift thyristor T and a light-emitting thyristor which is connected to T. Here, in a case where a specific shift thyristor among the shift thyristors T is indicated as shift thyristor Tn. Here, n is an integer greater than or equal to 2. This denotation will be used in the same manner for other components as well.

Φ1 is a transfer line for an odd-numbered shift thyristor T, and Φ2 is a transfer line for an even-numbered shift thyristor T. ΦW1 to ΦW3 are lighting signal lines of the light-emitting thyristor L. VGK is a gate line, and Φs is a start pulse line. In the configuration illustrated in FIG. 5, in relation to one shift thyristor Tn, three light-emitting thyristors (the light-emitting thyristors L from L3*n*−2 to L3*n*) are connected, and the three light-emitting thyristors are configured to be able to light simultaneously.

Here, operation of the light-emitting element array illustrated in FIG. 5 will be described. When 5V is applied to the gate line VGK, the voltage supplied to the transfer lines Φ1 and Φ2 are similarly made to be 5V. Also, the lighting signal lines ΦW1 to ΦW3 are inputs that the driving apparatus 100 of the present embodiment provides. When the shift thyristor Tn is in an on state, the electric potential of the common gate Gn of the shift thyristor Tn and the light-emitting thyristor Ln connected to the shift thyristor Tn is pulled down to approximately 0.2V. Since between the common gate Gn and the common gate Gn+1 is connected by the coupling diode Dn, a potential difference that is approximately equivalent is produced in the built-in potential of the coupling diode Dn. In the present embodiment, since the built-in potential of the coupling diode D is approximately 1.5V, the electric potential of the common gate Gn+1 is 1.7V resulting from adding the 0.2V of the electric potential of the common gate Gn to the 1.5V of the built-in potential. Hereinafter, similarly, the electric potential of the common gate Gn+2 will be 3.2V and the electric potential of the common gate Gn+3 will be 4.7V. However, for the common gate Gn+4 and higher, the voltage of the gate line VGK is 5V, and since it is determined by the voltage of the gate line VGK, it is 5V. Also, for those prior to the common gate Gn (the left side of FIG. 5), since the coupling diode D is reverse biased, the voltage of the gate line VGK is applied as is, and is 5V.

Figure 6A:
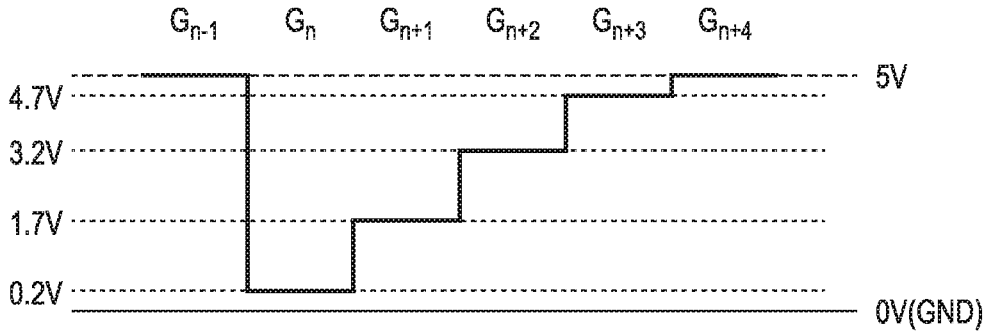
FIGS. 6A through 6C are views illustrating examples of drive timing for the light-emitting element array of FIG. 5.

A distribution of the gate potentials in the case where the shift thyristor Tn is in an on state is illustrated in FIG. 6A. There are cases where the voltage (hereinafter, may be denoted as a threshold voltage) needed for each shift thyristor T to operate in an ON state is approximately the same as with the built-in potential applied to each gate potential. In the case where the shift thyristor Tn is operating in the ON state, out of the shift thyristors T connected to the same transfer line Φ2, the one with the gate potential that is the lowest is the shift thyristor Tn+2. Accordingly, the electric potential of the common gate Gn+2 of the shift thyristor Tn+2, as described previously, is 3.2V, and therefore, the threshold voltage of the shift thyristor Tn+2 is 4.7V. However, since the shift thyristor Tn is operating in the ON state, the electric potential of the transfer line Φ2 is pulled to approximately 1.5V (built-in potential), and since it is lower than the threshold voltage of the shift thyristor Tn+2, the shift thyristor Tn+2 cannot operation in the ON state. Since the threshold voltages of the other shift thyristors T connected to the same transfer line Φ2 are all higher than the shift thyristor Tn+2, they similarly cannot operation in the ON state, and only the shift thyristor Tn can stay in the ON state.

Also, among the shift thyristors T connected to the transfer line Φ1, the threshold voltage of the shift thyristor Tn+1 whose threshold voltage is the lowest is 3.2V, and the next lowest threshold voltage is of the shift thyristor Tn+3 at 6.2V. When 5V is supplied to the transfer line Φ1 in this state, only the shift thyristor Tn+1 can transition to the on state. In this state, when the shift thyristor Tn and the shift thyristor Tn+1 simultaneously are turned on, the gate potentials of the shift thyristors T on the right of the shift thyristor Tn+1 are respectively pulled down in proportion to the built-in potential. However, since the gate line VGK is 5V, and the gate voltage is limited by the gate line VGK, to the right side of the shift thyristor Tn+5 is 5V. The gate voltage distribution in such a case is indicated in FIG. 6B. When the electric potential of the transfer line Φ1 drops to 0V in this state, the shift thyristor Tn transitions to the OFF state, and the electric potential of the common gate Gn rises to the electric potential of the gate line VGK. The gate voltage distribution in such a case is illustrated in FIG. 5C. In this way, transfer in the on state from the shift thyristor Tn to the shift thyristor Tn+1 completes.

Next, description regarding a light emission operation of the light-emitting thyristor L is given. Consider when only the shift thyristor Tn is operating in the ON state. Since the gate potentials of the three light-emitting thyristors light-emitting thyristor L3*n*−2 to L3*n* are connected commonly to the common gate Gn of the shift thyristor Tn, they are 0.2V which is the same as the common gate Gn. Accordingly, the threshold value of each of the light-emitting thyristors L3*n*−2 to L3*n* is 1.7V, and if a voltage of 1.7V or more from the lighting signal line ΦW1 to ΦW3 is supplied, lighting is possible. In other words, in the case where the shift thyristor Tn operates in the ON state, by supplying the lighting signal to the lighting signal lines ΦW1 to ΦW3, it is possible to emit light selectively by the appropriate combination of the three light-emitting thyristors L3*n*−2 to L3*n*. In such a case, the electric potential of the common gate Gn+1 of the shift thyristor Tn+1 arranged beside the shift thyristor Tn is 1.7V, and the threshold value of the light-emitting thyristors L3*n*+1 to L3*n*+3 connected to the common gate Gn+1 is 3.2V. In the case where the value of the lighting signals supplied from the lighting signal lines ΦW1 to ΦW3 is, for example, 5V, the light-emitting thyristors L3*n*+1 to L3*n*+3 seem to light up by the same lighting pattern as the lighting pattern of the light-emitting thyristors L3*n*−2 to L3*n*. However, since the threshold value is lower for the light-emitting thyristors L3*n*−2 to L3*n*, in the case where the lighting signal is supplied, operation in the ON state (lighting) is started earlier than the light-emitting thyristors L3*n*+1 to L3*n*+3. When first the light-emitting thyristors L3*n*-2 to L3*n* operate in the ON state, the connected lighting signal lines ΦW1 to ΦW3 are pulled to approximately 1.5V (built-in potential), and since this is lower than the threshold value of the light-emitting thyristors L3*n*+1 to L3*n*+3, it is not possible for the light-emitting thyristors L3*n*+1 to L3*n*+3 to operate in the ON state. In this way, by connecting a plurality of light-emitting thyristors L to one shift thyristor T, it is possible to simultaneously light a plurality of light-emitting thyristors L.

Figure 5:
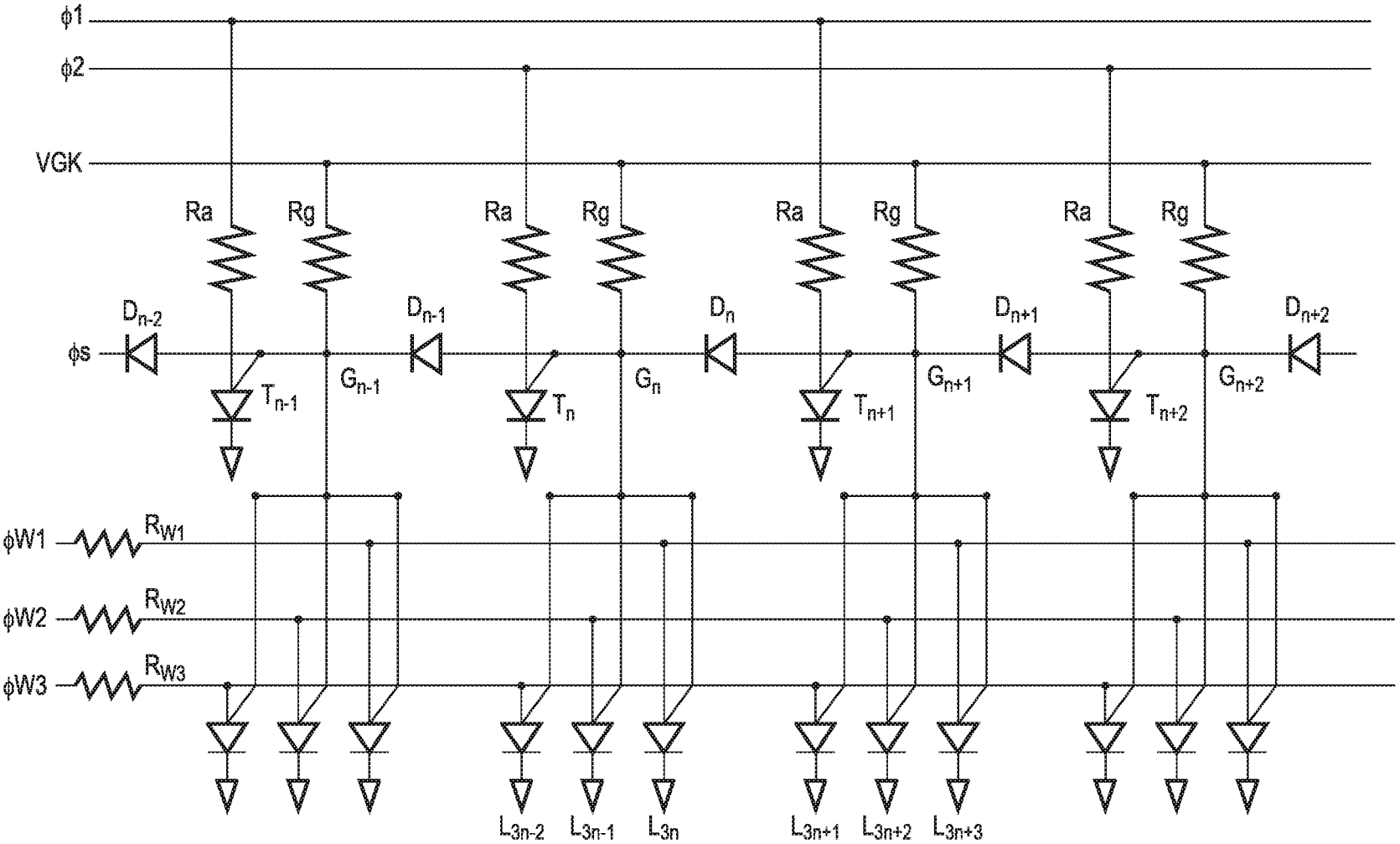
FIG. 5 is a circuit diagram illustrating an example of a configuration of a light-emitting element array driven by the driving apparatus of FIG. 1.
Figure 6B:
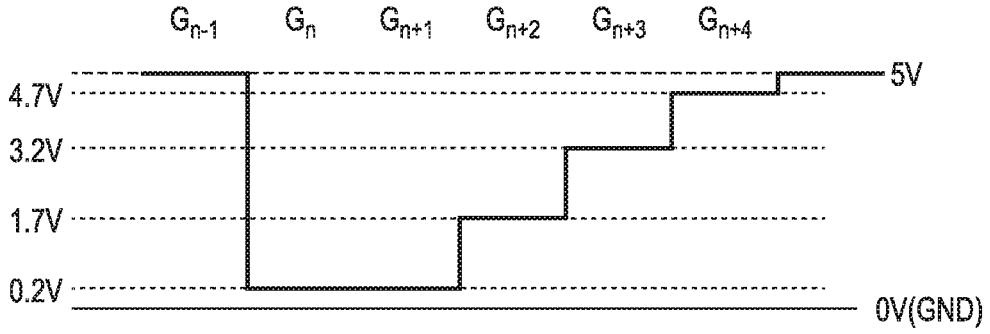
Figure 6C:
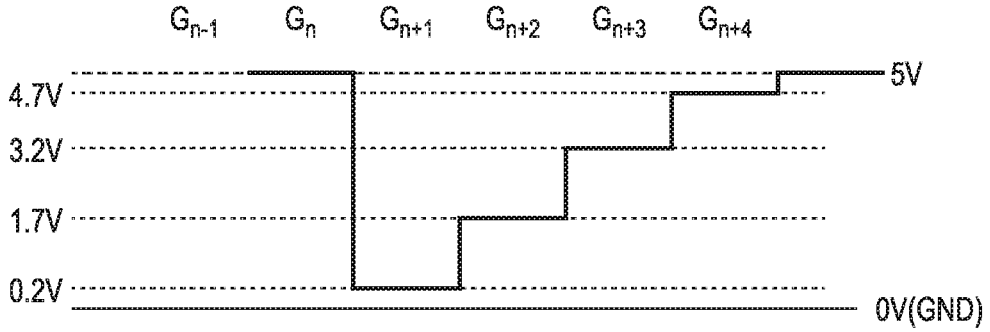
Figure 7:
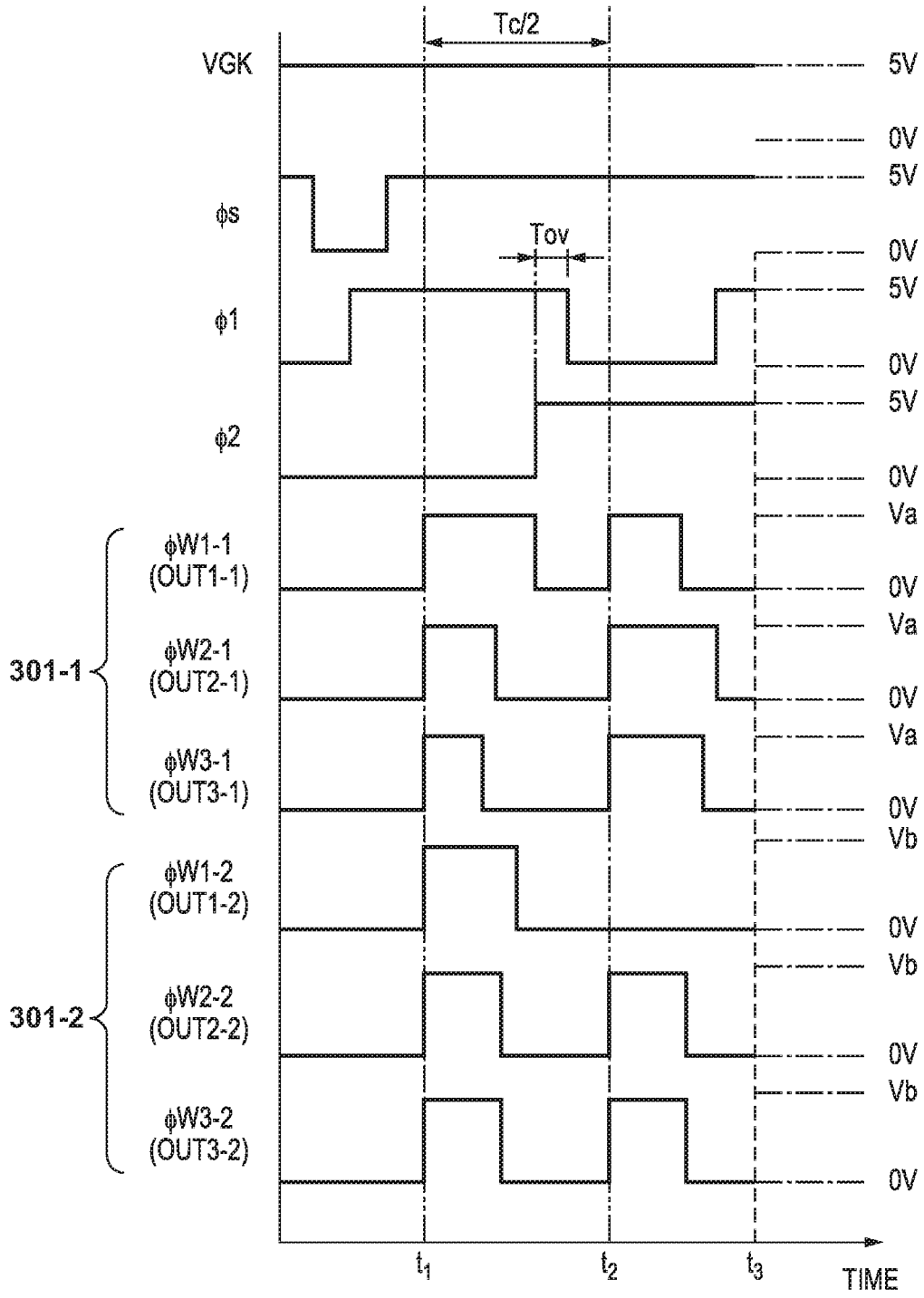
FIG. 7 is a view illustrating an example of drive timing of the driving apparatus of FIG. 1.

An example of a driving signal waveform of the light-emitting element array illustrated in FIG. 5 is illustrated in FIG. 7. Here, an example of a driving signal waveform of the light-emitting thyristors L of the light-emitting element arrays 201-1 and 201-2 connected to the output terminals OUT1-1 to OUT3-1 and 1-2 to 3-2 of the output circuit 1001 of the driving circuits 301-1 and 301-2 is illustrated. 5V is constantly supplied to the gate line VGK. 5V is supplied for the transfer line Φ1 for the odd-numbered shift thyristors T and the transfer line Φ2 for the even-numbered shift thyristors T at the same period (Tc). 5V is supplied to the start pulse line Φs, but slightly before the 5V is initially supplied to the transfer line Φ1, the start pulse line Φs is transitioned to 0V to create a potential difference in the gate line. Thereby, the gate of the initial shift thyristor T is pulled from 5V to 1.5V, the threshold value becomes 3.0V, and the shift thyristor T enters a state in which it can operate in the ON state by the signal according to the transfer line Φ1. 5V is applied to the transfer line Φ1, and 5V is supplied to the start pulse line Φs slightly delayed from when the shift thyristor T initially transitions into the ON state, and thereafter 5V continues to be supplied to the start pulse line Φs. There is a time Tov where the ON states (5V here) of the transfer line Φ1 and the transfer line Φ2 overlap each other, and configuration is such that there is an approximately complementary relation therebetween.

The gate line VGK, the transfer lines Φ1 and Φ2, and the start pulse line (Ds are common to the light-emitting element arrays. The output terminals OUT1-1 to OUT3-1 of the output circuits 1001-1 to 1001-3 of the driving circuit 301-1 are connected to the lighting signal lines ΦW1-1 to ΦW3-1 of the light-emitting element array 201-1. The output terminals OUT1-2 to OUT3-2 of the output circuits 1001-1 to 1001-3 of the driving circuit 301-2 are connected to the lighting signal lines ΦW1-2 to ΦW3-2 of the light-emitting element array 201-2. The lighting signal lines ΦW1-1 to ΦW3-1 and ΦW1-2 to ΦW3-2 of the light-emitting thyristor L are transmitted at a period (Tc/2) that is half the period of the transfer lines Φ1 and Φ2. In the case where the shift thyristor T is in the ON state, the corresponding light-emitting thyristor L lights when a voltage of the threshold value or more is applied.

The height of the pulse signal of the driving current IOUT that is outputted from the output terminals OUT1-1 to OUT3-1 to the output circuits 1001-1 to 1001-3 of the driving circuit 301-1, as described above, is the same height according to the input voltage Vin supplied from the voltage control unit 104. Similarly, the heights of the pulse signals of the driving current IOUT that are outputted from the output terminals OUT1-2 to OUT3-2 to the output circuits 1001-1 to 1001-3 of the driving circuit 301-2 are the same height. Meanwhile, the height of the pulse signal of the current IOUT outputted from the output terminals OUT1-1 to OUT3-1 of the output circuits 1001-1 to 1001-3 of the driving circuit 301-1 and the height of the pulse signal of the current IOUT outputted from the output terminals OUT1-2 to OUT3-2 of the output circuits 1001-1 to 1001-3 of the driving circuit 301-2 may be different. Therefore, the voltages applied to the lighting signal lines ΦW1-1 to ΦW3-1 and the lighting signal lines ΦW1-2 to ΦW3-2 are also different, and here are treated as the voltage Va and the voltage Vb. Between time t1 to time t2, three light-emitting thyristors L connected to the same shift thyristor T of the two light-emitting element arrays 201-1 and 201-2 connected respectively to the driving circuits 301-1 and 301-2 are all in a state of being lighted.

From time t1 to time t2, for the signals outputted from the output terminals OUT1-1 to OUT3-1 of the output circuits 1001-1 to 1001-3 of the driving circuit 301-1, the widths of the pulse signals differ for each output terminal based on the drive signals 1 to 3 supplied from the period control unit 102. In other words, the period in which the current for driving the light-emitting thyristor L is being supplied may differ for each of the output terminals OUT1-1 to OUT3-1 of the output circuits 1001-1 to 1001-3. It is similar for the driving circuit 301-2 as well. Also, in the period from time t1 to time t2 and from time t2 to time t3, the widths of the pulse signal of the signal outputted from the output terminal OUT1-1 of the output circuit 1001-1 of the driving circuit 301-1 may be different. It is similar at the output terminal OUT of other output circuits 1001. As described above, based on the drive signal supplied from the period control unit 102, the driving circuit 301 causes the width (the period in which a current for driving the light-emitting element is supplied) of the pulse signal for driving the light-emitting element to change. Thereby, even if the currents outputted from the output circuits 1001-1 to 1001-3 of the driving circuit 301 are the same, it is possible to correct variation in light emission by the light-emitting element in each light-emitting element array 201.

From time t1 to time t2, the widths of the pulse signal outputted from the output terminals OUT1-1 to OUT3-1 of the output circuits 1001-1 to 1001-3 of the driving circuit 301-1 and the pulse signal outputted from the output terminals OUT1-2 to OUT3-2 of the output circuits 1001-1 to 1001-3 of the driving circuit 301-2 may be different. At the same time, in different driving circuits 301, based on the drive signal supplied from the period control unit 102, it is possible to cause the width of the pulse signal which is a period in which a current for driving a light-emitting element is supplied to change. Also, as described above, the heights of the pulse signal of the current IOUT outputted from the driving circuit 301-1 and the pulse signal of the current IOUT outputted from the driving circuit 301-2 may differ. As described above, by changing the height of the pulse signal outputted from the output circuit 1001 of the driving circuit 301 and changing the width of the pulse signal, it is possible to correct variation in light emission by the light-emitting elements. As indicated from time t2 to time t3, as with the signal outputted from the output terminals OUT1-2 to OUT3-2 of the output circuits 1001-1 to 1001-3 of the driving circuit 301-2, it is possible to correct variation in light emission by changing the number of light-emitting thyristors that emit light simultaneously. In the present embodiment, the number of light-emitting thyristors L that connect to one shift thyristor T is three, but there is no limitation to this, and depending on intended use, it may be less than three, or four or more.

In the present embodiment above, in the current IOUT that is supplied to the light-emitting element arrays 201 arranged in the light emitting unit 200 from the driving circuits 301, the height of the pulse signal supplied from the output circuit 1001 for each driving circuit 301 is controlled. Furthermore, for each of the plurality of output circuits 1001 arranged in the driving circuit 301, the width of the pulse signal of the current IOUT to be supplied is controlled. Thereby, light emission variation between the light-emitting element arrays 201 arranged in the light emitting unit 200 and the light-emitting elements within the light-emitting element array 201 is corrected. Using the driving apparatus 100 comprising this driving circuit 301, a plurality of the light-emitting element array 201 respectively including light-emitting elements such as light-emitting thyristors are driven. Thereby, an increase in circuit scale for light amount adjustment is reduced, and it is possible to correct light emission variation of light-emitting elements and control light emission without increasing the chip size of the driving apparatus 100.

Figure 8:
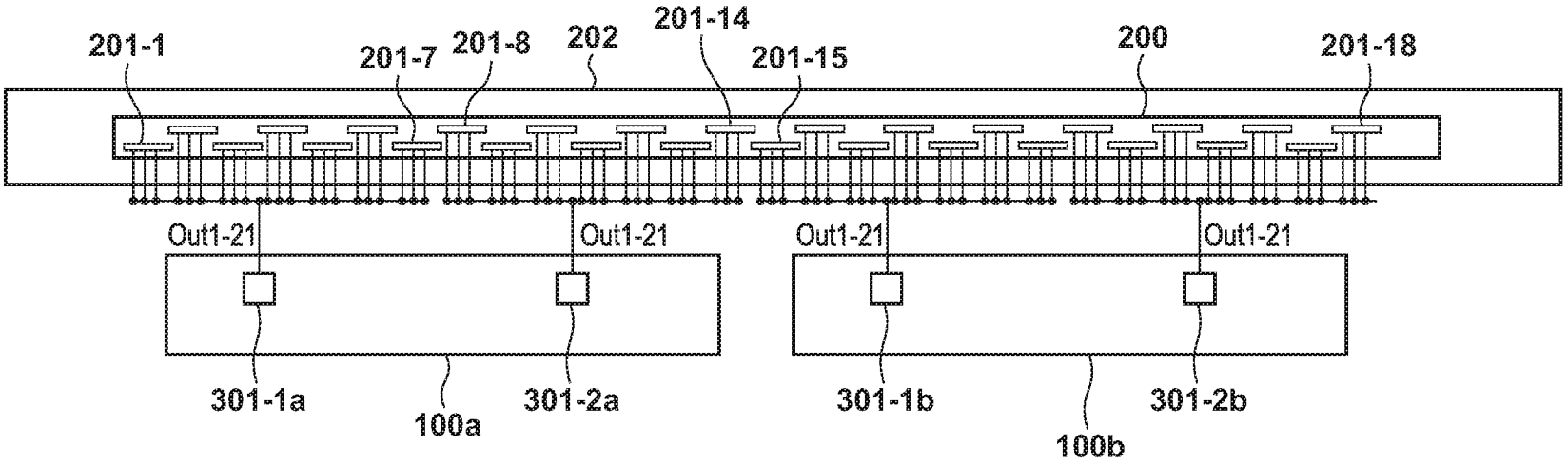
FIG. 8 is a view illustrating a variation of the relationship between the driving apparatus and the light-emitting element arrays of FIG. 3.

In the present embodiment, as illustrated in FIG. 3, in the driving apparatus 100, the same number of driving circuits 301 is arranged as the light-emitting element array 201 arranged in the light emitting unit 200. However, there is not limitation to this. For example, in the case where light emission variation between the light-emitting element arrays 201 is small, as illustrated in FIG. 8, one driving circuit 301 may control a plurality of light-emitting element arrays 201. In FIG. 8, an example in which two driving circuits 301 are arranged in one driving apparatus 100, and one driving circuit 301 controls seven light-emitting element arrays 201 is illustrated. The OUT terminals 1 to 21 of the output circuit 1001 of the driving circuit 301-1*a* are connected to the lighting signal lines ΦW of the light-emitting element array 201-1 to 201-7, and the OUT terminals 1 to 21 of the output circuit 1001 of the driving circuit 301-2*a* are connected to the lighting signal lines ΦW of the light-emitting element arrays 201-8 to 201-14. Even if the heights of the pulse signals of the current IOUT supplied to the different light-emitting element arrays 201 are the same, it is possible to perform control of light emission between light-emitting element arrays 201 by changing the width (output period) of the pulse signal to be supplied. By having such a configuration, compared with the case where the same number of driving circuits 301 as the light-emitting element arrays 201 are arranged in the driving apparatus 100, it is possible to further reduce the circuit scale and it is possible to further reduce the chip size of the driving apparatus 100.

Figure 9A:
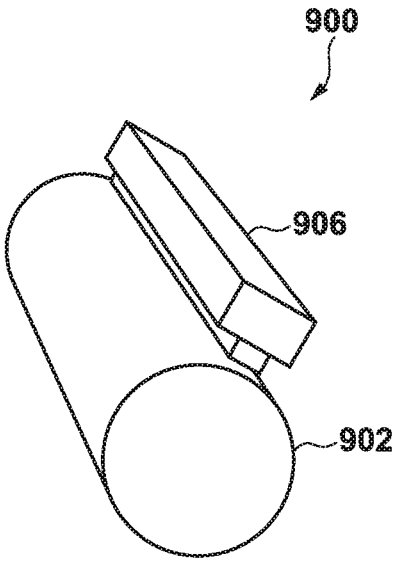
FIGS. 9A and 9B are views illustrating examples of a configuration of a printing apparatus comprising the driving apparatus of FIG. 1.
Figure 9B:
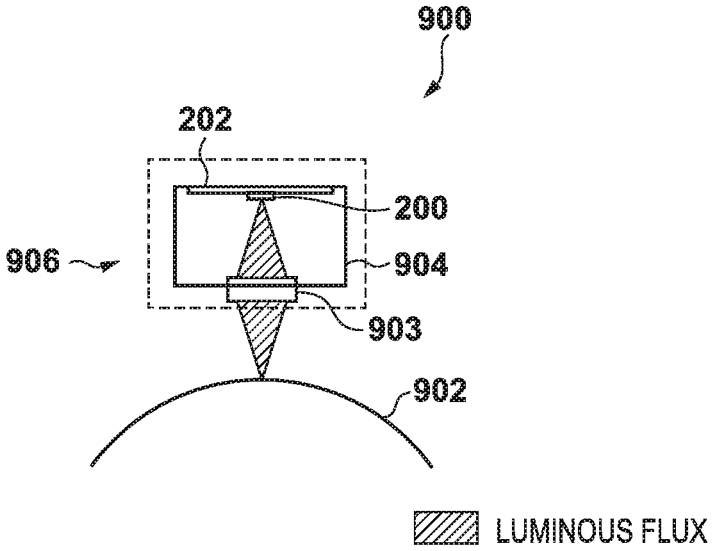

Below, a printing apparatus provided with elements that the driving apparatus 100 comprising the driving circuit 301 of the present embodiment drives are described. In FIG. 9A and FIG. 9B is illustrated a printing apparatus 900 including a plurality of light-emitting element arrays 201 as load element arrays and an exposure head 906 comprising the driving apparatus 100, and a photosensitive drum 902 for receiving light of each light-emitting element in which the plurality of light-emitting element arrays 201 are arranged. The light emitting unit 200 which comprises a plurality of light-emitting element arrays 201 is provided in the exposure head 906. In each of the light-emitting element arrays 201, a plurality of light-emitting elements are lined up in an array. For example, as illustrated in FIG. 3, each of the plurality of driving circuits 301 may drive a corresponding one of the plurality of light-emitting element arrays 201. Also, for example, as illustrated in FIG. 8, each of the plurality of driving circuits 301 may drive a corresponding two or more of the plurality of light-emitting element arrays 201. Here, as illustrated in FIGS. 3 and 8, each of the plurality of light-emitting element arrays 201 are formed in different semiconductor chips to each other. Also, the plurality of driving circuits 301 may be formed on a single semiconductor chip.

FIG. 9A illustrates an example in which the exposure head 906 is arranged in relation to the photosensitive drum 902, and FIG. 9B illustrates a state in which light irradiated from the light emitting unit 200 is focused on the photosensitive drum 902. The exposure head 906 and the photosensitive drum 902 are both attached to the printing apparatus 900 by a mounting portion (not shown). The exposure head 906 includes the light emitting unit 200 in which light-emitting elements whose driving is controlled by the driving apparatus 100 are arranged, the print substrate 202 that implements the light emitting unit 200, a rod lens array 903, and a housing 904 to which the rod lens array 903 and the print substrate 202 are attached. In FIG. 9A and FIG. 9B, the driving apparatus 100 is not shown graphically for simplification of the description. In the factory where the exposure head 906, for example, is produced, assembly adjustment work is performed individually, and focus adjustment of light emitted from each light-emitting element of the light emitting unit 200 and light amount adjustment may be performed. Here, the distance between the photosensitive drum 902 and the rod lens array 903 and the distance between the rod lens array 903 and the light emitting unit 200 and the like is arranged so as to be a predetermined interval. Thereby, the light emitted from the light emitting unit 200 forms an image on the photosensitive drum 902. For example, at the time of focus adjustment, so that the distance between the rod lens array 903 and the light emitting unit 200 become a desired value, adjustment of the attachment position of the rod lens array 903 is performed. Also, configuration may be taken so as to, at the time of light amount adjustment, cause each light-emitting element of the light emitting unit 200 to sequentially emit light, and store the variation (for example, the relationship between the input voltage Vin and the target light amount) in light caused to be focused via the rod lens array 903 in the memory 107 described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-164782, filed Sep. 10, 2019, which is hereby incorporated by reference herein in its entirety.

What is claimed is:

1. A driving apparatus, comprising:

a plurality of driving circuits configured to respectively drive a plurality of load element arrays each including a plurality of load elements, wherein each of the plurality of driving circuits comprises a plurality of output circuits configured to supply signals to a corresponding load element array of the plurality of load element arrays, and wherein:

a first driving circuit of the plurality of driving circuits is configured to supply first signals to a first load element array of the plurality of load element arrays, and a second driving circuit of the plurality of driving circuits is configured to supply second signals to a second load element array of the plurality of load element arrays, a voltage of the first signals is different from a voltage of the second signals so as to correct a variation between the first load element array and the second load element array, widths of the first signals are controlled so as to correct a variation between the plurality of load elements of the first load element array, and widths of the second signals are controlled so as to correct a variation between the plurality of load elements of the second load element array.

2. The driving apparatus according to claim 1, further comprising a period control unit configured to control widths of the signals supplied from each of the plurality of driving circuits to a corresponding load element array of the plurality of load element arrays so as to correct the variation between the plurality of load elements in each of the plurality of load element arrays.

3. The driving apparatus according to claim 1, further comprising a voltage control unit configured to control a voltage of the signals supplied from each of the plurality of driving circuits to a corresponding load element array of the plurality of load element arrays so as to correct the variation between the plurality of load element arrays.

4. The driving apparatus according to claim 1, further comprising:

a voltage control unit configured to control a voltage of the signals supplied from each of the plurality of the driving circuits to a corresponding load element array of the plurality of load element arrays so as to correct the variation between the plurality of load element arrays; and a period control unit configured to control widths of the signals supplied from each of the plurality of the driving circuits to a corresponding load element array of the plurality of load element arrays so as to correct the variation between the plurality of load elements in each of the plurality of load element arrays, wherein the voltage control unit is configured to control the voltage of the signals with a first bit-width resolution, and the period control unit is configured to control the widths of the signals with a second bit-width resolution which is larger than the first bit-width resolution.

5. The driving apparatus according to claim 3, further comprising a memory in which information for controlling driving of the plurality of load elements respectively is stored, wherein the voltage control unit respectively supplies to the plurality of driving circuits voltages controlled based on the information of the memory.

6. The driving apparatus according to claim 1, wherein the plurality of load elements are current-driven elements.

7. The driving apparatus according to claim 1, wherein the plurality of load elements are light-emitting elements.

8. The driving apparatus according to claim 7, wherein the light-emitting elements are light-emitting thyristors.

9. A printing apparatus, comprising:

the driving apparatus according to claim 1, and an exposure head comprising a plurality of light-emitting element arrays as at least one load element array; and a photosensitive drum configured to receive light of the plurality light-emitting element arrays, wherein each of the plurality of driving circuits drives a corresponding one of the plurality of light-emitting element arrays.

10. The printing apparatus according to claim 9, wherein plurality of light-emitting element arrays are formed in mutually different semiconductor chips.

* * * * *